US009217575B2

(12) United States Patent
Dazai

(10) Patent No.: US 9,217,575 B2
(45) Date of Patent: Dec. 22, 2015

(54) AIR-CONDITIONING CONTROLLING SYSTEM AND AIR-CONDITIONING CONTROLLING METHOD

(75) Inventor: Ryouta Dazai, Tokyo (JP)

(73) Assignee: AZBIL CORPORATION, Tokyo (JP)

( * ) Notice: Subject to any disclaimer, the term of this patent is extended or adjusted under 35 U.S.C. 154(b) by 616 days.

(21) Appl. No.: 13/545,769

(22) Filed: Jul. 10, 2012

(65) Prior Publication Data

US 2013/0014927 A1 Jan. 17, 2013

(30) Foreign Application Priority Data

Jul. 11, 2011 (JP) ..... 2011-152506

(51) Int. Cl.
*F24F 3/044* (2006.01)
*F24F 11/053* (2006.01)

(52) U.S. Cl.
CPC ..... *F24F 3/044* (2013.01); *F24F 11/053* (2013.01); *F24F 2221/54* (2013.01)

(58) Field of Classification Search
CPC ..... F24F 3/052; F24F 3/044; F24F 11/053; F24F 2221/54
USPC ..... 700/276; 165/49.3, 217, 208
See application file for complete search history.

(56) References Cited

U.S. PATENT DOCUMENTS 4,811,897 A * 3/1989 Kobayashi et al. ..... 236/49.3
4,819,714 A * 4/1989 Otsuka et al. ..... 165/217
4,997,029 A * 3/1991 Otsuka et al. ..... 165/209
4,997,030 A * 3/1991 Goto et al. ..... 165/208
5,725,148 A * 3/1998 Hartman ..... 236/49.3
5,769,314 A * 6/1998 Drees et al. ..... 236/49.3
5,976,010 A * 11/1999 Reese et al. ..... 454/229

(Continued)

FOREIGN PATENT DOCUMENTS

JP H04-161750 6/1992
JP H10-300171 A 11/1998
JP 2000-304333 11/2000
KR 10-2004-0088629 A 10/2004

OTHER PUBLICATIONS

Korean Office Action, dated Oct. 1, 2013, which issued during the prosecution of Korean Patent Application No. 10-2012-0052446.

(Continued)

*Primary Examiner* — Mohammad Ali
*Assistant Examiner* — Ziaul Karim
(74) *Attorney, Agent, or Firm* — Troutman Sanders LLP

(57) ABSTRACT

In an air-cooling-and-heating controlling system, individual variable air volume controllers send, to an air-cooler-and-heater controller, current cooling/heating requirement information for the controlled area that is controlled by that variable air volume controller. If there is a mixing of a cooling requirement and a heating requirement in the cooling/heating requirement information that is received, the air-cooler-and-heater controller establishes a cold air temperature setting value and a hot air temperature setting value that can handle the cooling requirements and the heating requirements at that time, to perform alternating switching of a supply air temperature setting value. If a variable air volume controller that requires heating is supplied cold air, it blocks the supply of air to the controlled area. If a variable air volume controller that requires cooling is supplied hot air, it blocks the supply of air to the controlled area.

8 Claims, 13 Drawing Sheets

(56) References Cited

U.S. PATENT DOCUMENTS

| | | | | |
|---|---|---|---|---|
| 8,793,022 | B2 * | 7/2014 | Uden | 700/282 |
| 2001/0042792 | A1 * | 11/2001 | Kline et al. | 236/49.3 |
| 2006/0159007 | A1 * | 7/2006 | Frutiger et al. | 370/216 |

OTHER PUBLICATIONS

Japanese Office Action mailed Jan. 6, 2015, which issued during prosecution of Japanese Application No. 2011-152506, which corresponds to the present application.

* cited by examiner

| | VAV Requiring Cooling | VAV Requiring Heating |
|---|---|---|
| When the supply air is cold air: Supply Air Temperature < Room Temperature (tSpv< tpv) |  | Block supply air. |
| When the supply air is hot air: Temperature <Supply Air Temperature (tpv< tSpv) | Block supply air. |  |

AIR-CONDITIONING CONTROLLING SYSTEM AND AIR-CONDITIONING CONTROLLING METHOD

CROSS REFERENCE TO RELATED APPLICATIONS

The present application claims priority under 35 U.S.C. §119 to Japanese Patent Application No. 2011-152506, filed Jul. 11, 2011, which is incorporated herein by reference.

FIELD OF TECHNOLOGY

The present invention relates to an air cooling and heating controlling system and air cooling and heating controlling method for controlling an airflow rate of air that is supplied to a plurality of controlled areas from an air cooler and heater based on the load statuses of the controlled areas, and for controlling the temperature of the air supplied from the air cooler and heater so as to go to a supply air temperature setting value.

BACKGROUND

Conventionally in, for example, variable air volume (VAV) controlling systems, airflow rate regulating units (VAV units) have been provided in ducts for supplying air to controlled areas from an air cooler and heater, where the degrees of opening of the dampers in the VAV units have been controlled depending on the temperature deviations between the room temperatures of the controlled areas and the room temperature setting values, to regulate the rates with which air is supplied to the controlled areas. In this case, the VAV unity is provided with a VAV controller, where the control of the degree of opening of the damper of the VAV unit is performed by the VAV controller. The VAV unit and VAV controller are provided for each individual controlled area as a variable air volume unit.

On the other hand, an air-cooler-and-heater controller is provided for the air cooler and heater, where the current control status of each VAV unit (a control status which indicates the current load status of the controlled area) is sent from each individual controller to the air-cooler-and-heater controller, where the air-cooler-and-heater controller determines the load status for all of the controlled areas as a whole from the control statuses of the individual VAV units and the control status of the air cooler and heater, and then determines the temperature of the supply air from the air cooler and heater (that is, the supply air temperature setting value) for the air that is supplied from the air cooler and heater, based thereon (See, for example, Japanese Unexamined Patent Application Publication 2000-304333).

However, in the conventional VAV controlling system set forth above, the supply air temperature is the same temperature for all of the VAV units, making it impossible to accommodate simultaneous requirements for both cooling and heating. That is, because the supply air temperature setting value that is determined by the air-cooler-and-heater controller is only a single value, even though it is possible, for example, to handle a controlled area that requires cooling, it would not be possible to handle a controlled area that requires heating at the same time, as cold air would be supplied to the controlled area that requires heating. Because of this, the room temperature within the controlled area that requires heating would be lower than the room temperature setting value.

The examples of the present invention solve the problem set forth above, and the object thereof is to provide an air cooling and heating controlling system and air cooling and heating controlling method able to accommodate simultaneous cooling and heating requirements.

SUMMARY

In order to achieve the object set forth above, the examples of the present invention are an air cooling and heating controlling system including a plurality of supply air flow rate controlling means for controlling flow rates of supply air that is supplied from an air cooler and heater to a plurality of controlled areas in accordance with load statuses of the controlled areas, and supply air temperature controlling means for controlling, to a supply air temperature setting value, the temperature of the air that is supplied from the air cooler and heater to the plurality of controlled areas, wherein: each supply airflow rate controlling means comprise requirement sending means for sending to the supply air temperature controlling means cooling/heating requirement information indicating whether the current load status of the controlled area controlled by that supply air flow rate controlling means requires cooling or requires heating; and the supply air temperature controlling means comprise cold air/hot air switching means for receiving the cooling/heating requirement information sent from the individual supply air flow rate controlling means, for setting a cold air temperature setting value and a hot air temperature setting value able to accommodate the cooling requirements and heating requirements at that time if there is a mixture of a cooling requirement and a heating requirement in the cooling/heating requirement information that has been received, and for alternatingly switching the supply air temperature setting value between the cold air temperature setting value and the hot air temperature setting value that have been determined.

In the examples of the present invention, if there is a mixture of cooling requirements and heating requirements in the requirement information for switching/cooling sent from the individual supply airflow rate controlling means, the supply air temperature controlling means establish a cold air temperature setting value and a hot air temperature setting value that are able to accommodate the cooling requirements and the heating requirements at that time, and then switches the supply air temperature setting value back and forth between the cold air temperature setting value and the hot air temperature setting value that have been set. Doing so causes cycling between supplying cold air and supplying hot air, with the temperature of the air that is supplied from the air cooler and heater fluctuating between the cold air temperature setting value and the hot air temperature setting value.

Here, at the time of supplying cold air, for example, the supply of air to the controlled areas that require heating would be blocked off (that is, the supply air would be blown into the controlled areas that require cooling), where, at the time of supplying hot air, the supply of air to the controlled areas that require cooling would be blocked off (that is, the supply air would be blown into the controlled areas that require heating), thus making it possible to accommodate simultaneous requirements for cooling and heating.

In the examples of the present invention, cooling and heating requirement information that are sent from the individual supply air flow rate controlling means are received, and if there is a mixture of cooling requirements and heating requirements in the cooling/heating requirement information that has been received, then a cold air temperature setting value and a hot air temperature setting value that can respond to the cooling requirements and the heating requirements at that time are established, and the supply air temperature setting value is switched back and forth between the cold air temperature setting value and the hot air temperature setting value that have been set, thus cycling between supplying cold air and supplying hot air with the temperature of the air that is supplied from the air cooler and heater fluctuating between the cold air temperature setting value and the hot air temperature setting value, where, at the time of cooling, the supply of air to the controlled area requiring heating is blocked off and, at the time of supplying hot air, the supply of air to the controlled area requiring cooling is blocked off, thus making possible to accommodate simultaneous requirements for cooling and heating.

DETAILED DESCRIPTION

Figure 1:
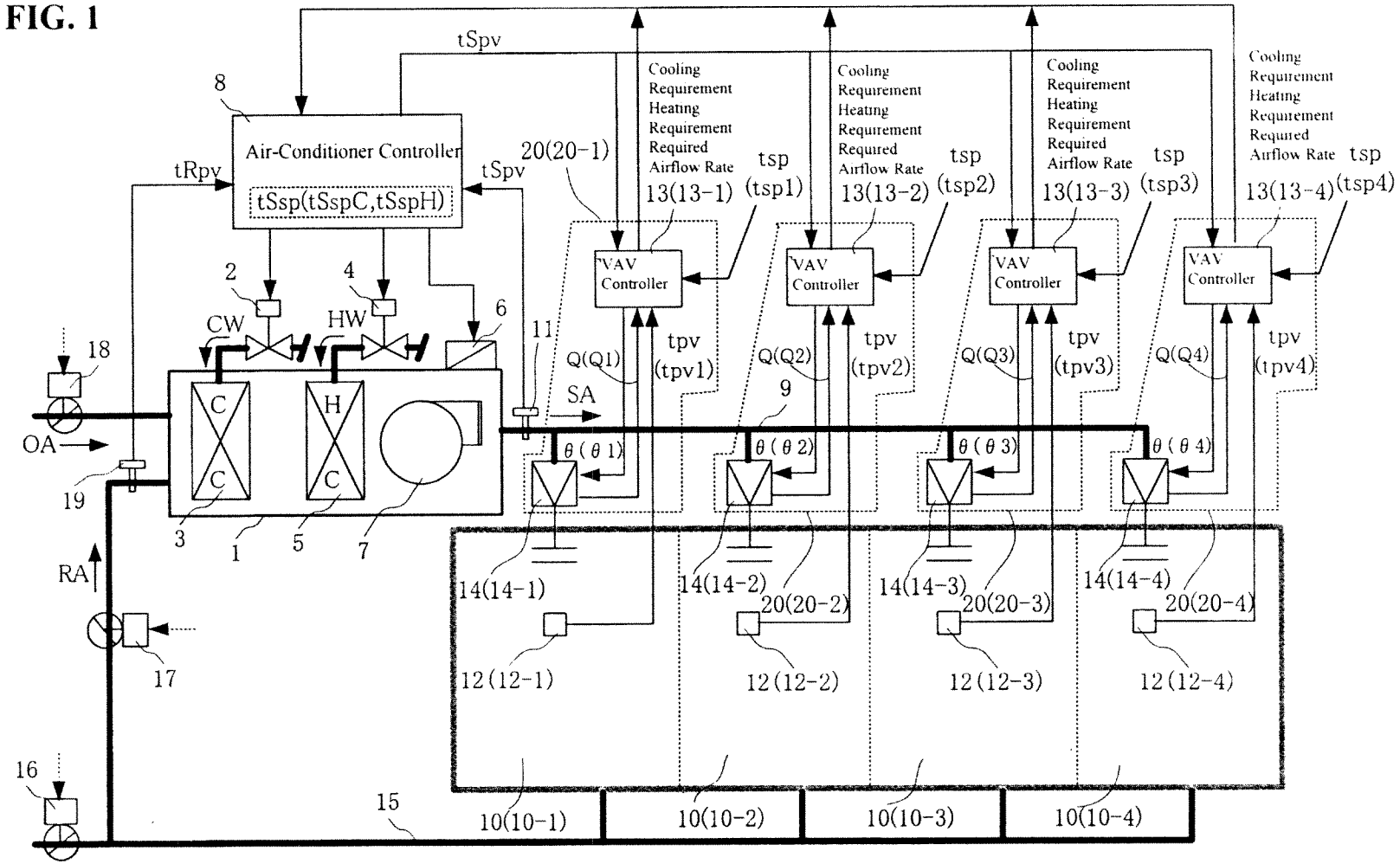
FIG. 1 is an instrumentation drawing of a VAV controlling system illustrating an example according to the present invention.

An example according to the present invention is explained below in detail, based on the drawings. FIG. 1 is an instrumentation drawing of a VAV controlling system illustrating one example according to the present invention.

In this figure, 1 is an air cooler and heater, and is provided with a cold water coil 3 for supplying cold water CW through a cold water valve 2, a hot water coil 5 for supplying hot water HW through a hot water valve 4, and a supply air fan 7, the speed of rotation thereof being controlled through an inverter 6. 8 is an air-cooler-and-heater controller for controlling the operation of the air cooler and heater 1.

In this VAV controlling system, the supply air SA from the air cooler and heater 1, which is blown out by a supply air fan 7 through the cold water coil 3 and the hot water coil 5, is supplied to the controlled areas 10-1 through 10-4 through a supply air duct 9. The supply air duct 9 is provided with a supply air temperature sensor 11 for detecting the temperature of the supply air SA from the air cooler and heater 1. The supply air temperature tSpv, detected by the supply air temperature sensor 11, is sent to the air-cooler-and-heater controller 8.

The controlled areas 10-1 through 10-4 are each provided with a temperature sensor 12-1 through 12-4 for detecting the room temperature in each of the individual areas, where the room temperatures tpv1 through tpv4, detected by the temperature sensors 12-1 through 12-4, are applied to the individual VAV controllers 13-1 through 13-4 that are provided locally.

The VAV controllers 13 (13-1 through 13-4) calculate required airflow rates for the controlled areas 10 (10-1 to 10-4) based on the supply air temperature tSpv sent from the air-cooler-and-heater controller 8 and on the temperature deviations Δt (Δt1 through Δt4) between the room temperatures tpv (tpv1 through tpv4) and the room temperature setting values tsp (tsp1 through tsp4) and send them to the air-cooler-and-heater controller 8, while, on the other hand, in order to maintain the required airflow rate, controls the damper openings data (θ1 through θ4) of the VAV units 14 (14-1 through 14-4) while observing the actual airflow rates Q (Q1 through the Q4).

In this type of VAV controlling system, a variable airflow volume unit 20-1 is structured from a VAV controller 13-1 and a VAV unit 14-1, a variable airflow volume unit 20-2 is structured from a VAV controller 13-2 and a VAV unit 14-2, a variable airflow volume unit 20-3 is structured from a VAV controller 13-3 and a VAV unit 14-3, and a variable airflow volume unit 20-4 is structured from a VAV controller 13-4 and a VAV unit 14-4.

The air-cooler-and-heater controller 8 receives required airflow rates from the VAV controllers 13-1 through 13-4, calculates the total required airflow rate for the system as a whole from the required airflow rates that have been received, and controls the speed of rotation of the supply air fan 7 of the air cooler and heater 1 as to secure this total required airflow rate. Moreover, the current supply air temperature tSpv is sent to the VAV controllers 13-1 through 13-4.

On the other hand, the VAV controllers 13 (13-1 through 13-4) periodically use information such as the statuses of control of the VAV units 14 (14-1 through 14-4), the room temperatures tpv (tpv1 through tpv4, the room temperature setting values tsp (tsp1 through tsp4, the supply air temperature tSpv, and the like, to evaluate whether or not the current load statuses of the controlled areas 10 (10-1 through 10-4) require cooling or require heating, and if the evaluation is that cooling is required, send a "cooling requirement" as the cooling/heating requirement information, or if the evaluation is that heating is required, send a "heating requirement" as the cooling/heating requirement information, to the air-cooler-and-heater controller 8.

The air-cooler-and-heater controller 8 receives the cooling/heating requirement information from the VAV controllers 13-1 through 13-4, determines the supply air temperature setting value tSsp based on the cooling/heating requirement information that has been received, and controls the degrees of opening of the cold water valve 2 and the hot water valve 4 so as to cause the supply air temperature tSpv, detected by the supply air temperature sensor 11, to go to the supply air temperature setting value tSsp. That is, the amount of cold/hot water supplied to the cold water coil 3 and the hot water coil 5 are controlled.

In this VAV controlling system, the supply air SA that is supplied to the controlled areas 10-1 through 10-4 through the VAV units 14-1 through 14-4, after contributing to the air cooling and heating control in the controlled areas 10-1 through 10-4, is exhausted through the return air duct 15 and the exhaust air regulating damper 16, but a portion thereof is returned to the air cooler and heater 1 as return air RA through the return air regulating damper 17. Moreover, outside air OA is incorporated, through an outside air regulating damper 18, into the return air RA that is returned to the air cooler and heater 1.

Note that the degrees of opening of the exhaust air regulating damper 16, the return air regulating damper 17, and the outside air regulating damper 18 are regulated by commands from the air-cooler-and-heater controller 8. Moreover, a return air temperature sensor 19 is provided in a duct for the return air RA that is returned to the air cooler and heater 1. The return air temperature tRpv that is detected by the return air temperature sensor is sent to the air-cooler-and-heater controller 8.

The air-cooler-and-heater controller 8 has a cold air/hot air switching function, as a function that is unique to the present form of embodiment, which is enabled through hardware, which comprises a processor and a storage device, and a program that achieves a variety of functions in coordination with this hardware. Moreover, the VAV controller 13 also has a supply air blocking function and a function for calculating the magnitudes of cooling/heating requirements, as functions that are unique to the present form of embodiment, enabled through hardware, which has a processor and a storage device, and a program that achieves a variety of functions in coordination with this hardware.

The supply air blocking function of the VAV controller 13 is explained first.

Figure 2:
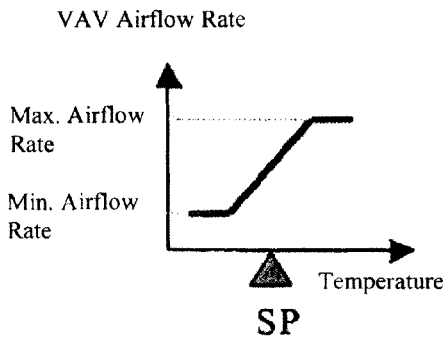
FIG. 2 is a drawing for explaining the supply air blocking function of a VAV controller in the VAV controlling system.
Figure 2:
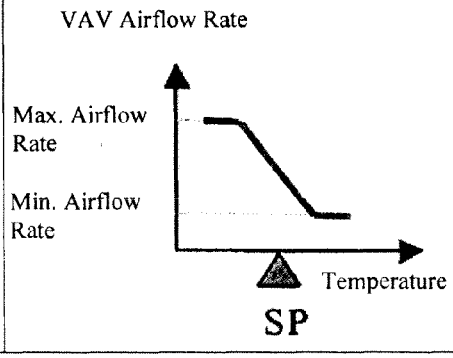

The VAV controller 13 has, as the supply air blocking functions, a first supply air blocking function and a second supply air blocking function. In the first supply air blocking function, the air supplied to the controlled area 10 is blocked through an evaluation that cold air is being supplied as the supply air when the current load state in the controlled area 10 requires hot air and the supply air temperature tSpv is lower than the room temperature tpv (that is tSpv<tpv). In the second supply air blocking function, the air supplied to the controlled area 10 is blocked through an evaluation that hot air is being supplied as the supply air when the current load state in the controlled area 10 requires cold air and the supply air temperature tSpv is higher than the room temperature tpv (that is tpv<tSpv). (See FIG. 2.)

The function for calculating the magnitudes of the cold/hot requirements in the VAV controller 13 will be explained next.

When the supply air is cold air (tSpv<tpv), the VAV controller 13 calculates the magnitude of a cooling requirement using Equation (1), below, and calculates the magnitude of a heating requirement using Equation (2), below, and sends the result as cooling/heating requirement information to the air-cooler-and-heater controller 8.

$$\text{Cooling requirement}=(tpv(\text{room temperature})-tSpv(\text{supply air temperature}))\times Q(\text{measured airflow rate}) \quad (1)$$

$$\text{Heating requirement}=(tsp(\text{room temperature setting value})-tpv(\text{room temperature})) \quad (2)$$

When the supply air is hot air (tpv<tSpv), the VAV controller 13 calculates the magnitude of a cooling requirement using Equation (3), below, and calculates the magnitude of a heating requirement using Equation (4), below, and sends the result as cooling/heating requirement information to the air-cooler-and-heater controller 8.

$$\text{Cooling requirement}=tpv(\text{room temperature}))-tsp(\text{room temperature setting value}) \quad (3)$$

$$\text{Heating requirement}=(tSpv(\text{supply air temperature})-tpv(\text{room temperature}))-\times Q(\text{measured airflow rate}) \quad (4)$$

Note that the return air temperature tRpv is sent to the VAV controller 13 and the return air temperature tRpv and the supply air temperature tSpv are compared, to evaluate whether the supply air is cold air or hot air, where in the aforementioned Equations (1) through (4), the room temperature tpv may be used instead of the return air temperature tRpv. Note that the function for calculating the magnitude of the cooling/heating requirement may be provided on the air-cooler-and-heater controller 8 side instead.

A cold air/hot air switching function in an air-cooler-and-heater controller 8 is explained next following the flow chart illustrated in FIG. 3.

The air-cooler-and-heater controller 8 receives, from the VAV controllers 13-1 through 13-4, cooling/heating requirement information and required airflow rates (Step S101), and evaluates whether or not there is a mixture of a cooling requirement and a heating requirement in the cooling/heating requirement information (Step S102).

If there is no mixture of a cooling requirement and a heating requirement in the cooling/heating requirement information (Step S102: NO), then normal supply air temperature control is performed (Step S103). Load reset control, or the like, is performed in this normal supply air temperature control.

In load reset control, if it is not possible to satisfy the cooling/heating requirements from the VAV controllers 13-1 through 13-4 even when the speed of rotation of the supply air fan 7 is at the maximum, then capability of the supply air temperature from the air cooler and heater 1 is turned up to overcome this state of deficiency. That is, if a cooling requirement cannot be satisfied, then the supply air temperature setting value tSsp is lowered, to overcome this state of the deficiency. If a heating requirement cannot be satisfied, then the supply air temperature setting tSsp increased to overcome the state of deficiency.

If there is a mixture of a cooling requirement and a heating requirement in the cooling/heating requirement information (Step S102: YES), then the air-cooler-and-heater controller 8 establishes control parameters for cold air/hot air switching control (Step S104). In this case, the hot air temperature setting value tSspH, the cold air temperature setting value tSspC, the time interval when switching back and forth between the cold air temperature setting value tSspC and the hot air temperature setting value tSspH (the cold/hot air switching time interval) T, and the time interval for executing the cold air/hot air switching control (the cold air/hot air switching control execution time interval TC) are sent as the control parameters. In this example, the cold air temperature setting value tSspC, the hot air temperature setting value tSspH, and the cold/hot air switching time interval T are set based on the magnitude relationships between the cooling requirements and the heating requirements at that time, where the cold air/hot air switching control execution time interval TC is a time interval that is set in advance. Determining the Cold Air Temperature Setting Value tSspC, the Hot Air Temperature Setting Value tSspH, and the Cold/Hot Air Switching Time Interval T The air cooling and heating controller 8 determines the cold air temperature setting value tSspC, the hot air temperature setting value tSspH, and the cold/hot air switching time interval T as described below from the cooling/heating requirement information received from the VAV controllers 13-1 through 13-4.

First the cooling requirements and the heating requirements from the VAV controllers 13-1 through 13-4 are each counted. The supply air temperature tSpv and the return air temperature tRpv are compared, and if the supply air temperature tSpv is lower than the return air temperature tRpv (tSpv<tRpv), then it is determined that cold air is being supplied as the supply air, but if the supply air temperature tSpv is greater than the return air temperature tRpv (tSpv>tRpv), it is determined that hot air is being supplied as the supply air.

Figure 4:
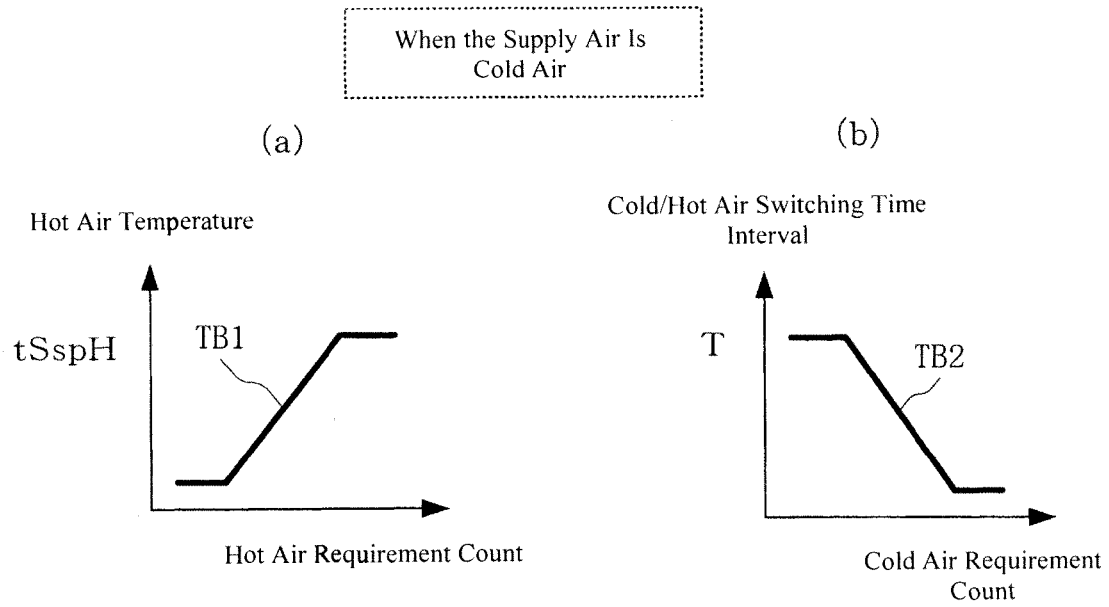
FIG. 4 is a diagram illustrating a table that is used when determining the hot air temperature setting value and the cold air flow switching time interval when the supply air is hot air in the air-cooler-and-heater controller.

Moreover, when the supply air is cold air, then the hot air temperature setting value tSspH is determined using Table TB1, shown in FIG. 4 (*a*), and the cold/hot air switching time interval T is determined from Table TB2, shown in FIG. 4 (*b*). That is, when the supply air is cold air, then the greater the heating requirement count, from the counting of the heating requirements, the higher the hot air temperature setting value tSspH is set, and, from the counting of the cooling requirements, the lower the cooling requirement count, the longer the cold air/hot air switching time interval T is set. Note that for the cold air temperature setting value tSspC, the supply air temperature setting value tSsp at that time is used as the cold air temperature setting value tSspC.

Figure 5:
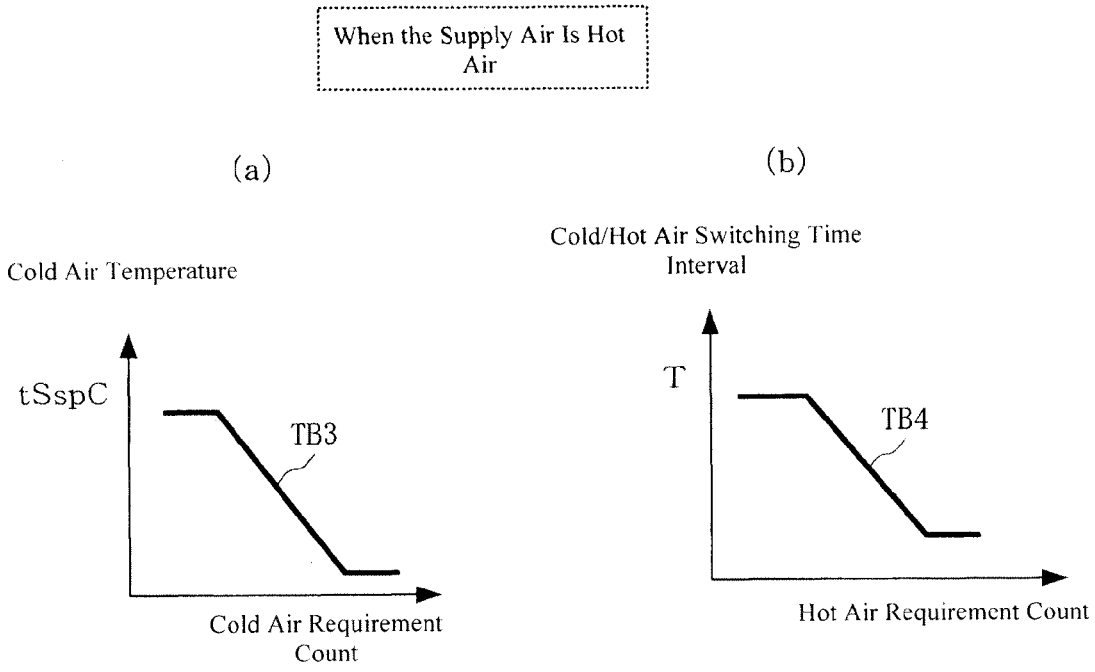
FIG. 5 is a diagram illustrating a table that is used when determining the cold air temperature setting value and the cold/hot air switching time interval when the supply air is hot air in the cooler and heater controller.

When the supply air is hot air, then the cold air temperature setting value tSspC is determined using Table TB2, shown in FIG. 5 (*a*), and the cold/hot air switching time interval T is determined from Table TB4, shown in FIG. 5 (*b*). That is, when the supply air is hot air, then the greater the cooling requirement count, from the counting of the cooling requirements, the lower the cold air temperature setting value tSspC is set, and, from the counting of the heating requirements, the lower the heating requirement count, the longer the cold air/hot air switching time interval T is set. Note that for the hot air temperature setting value tSspH, the supply air temperature setting value tSsp at that time is used as the hot air temperature setting value tSspH.

Cold Air/Hot Air Switching Control

Given this, the air-cooler-and-heater controller 8, simultaneously with starting the clock for the cold air/hot air switching execution time interval TC (Step S105), starts the cold air/hot air switching control using the cold air temperature setting value tSspC, the hot air temperature setting value tSspH, and the cold/hot air switching time interval T that were established in Step S104 (Step S106). That is, as illustrated in FIG. 6 (*a*), control wherein the supply air temperature setting value tSsp is switched alternatingly between the cold air temperature setting value tSspC and the hot air temperature setting value tSspH with the cold/hot air switching time interval T is started.

In this cold air/hot air switching control, there is cycling between supplying cold air and supplying hot air, with the temperature of the air that is supplied from the air cooler and heater 1 fluctuating between the cold air temperature setting value tSspC and the hot air temperature setting value tSspH. This cold air/hot air switching control is terminated at the point in time at which the timing of the cold air/hot air switching control execution time interval TC, which was started in Step S105, is completed (Step S107: YES). After the cold air/hot air switching control has been terminated, control returns to Step S101, and the operations set forth above are repeated.

Figure 6:
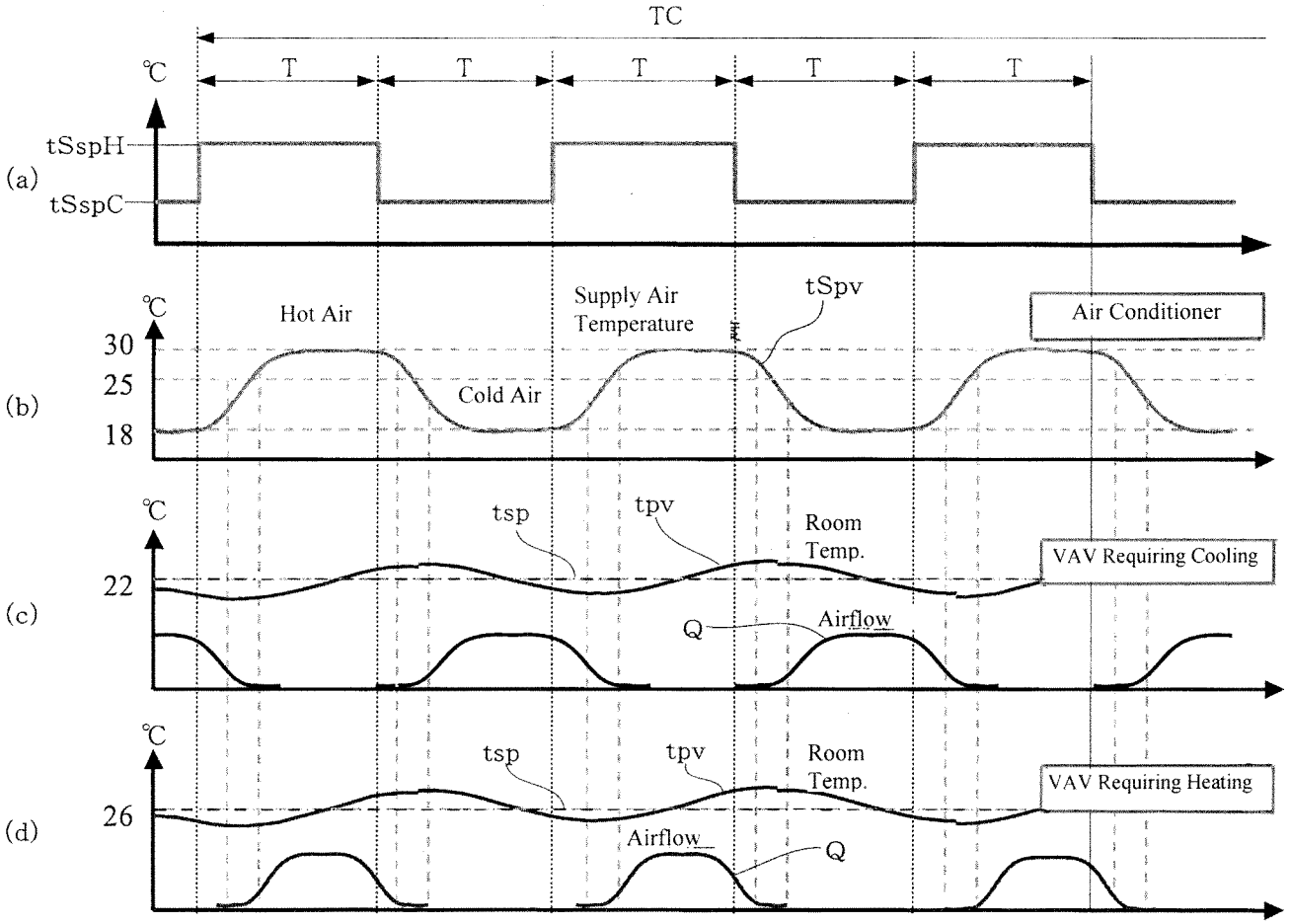
FIG. 6 is a flowchart for explaining the cold air/hot air switching control that is executed by the air-cooler-and-heater controller.
Figure 7:
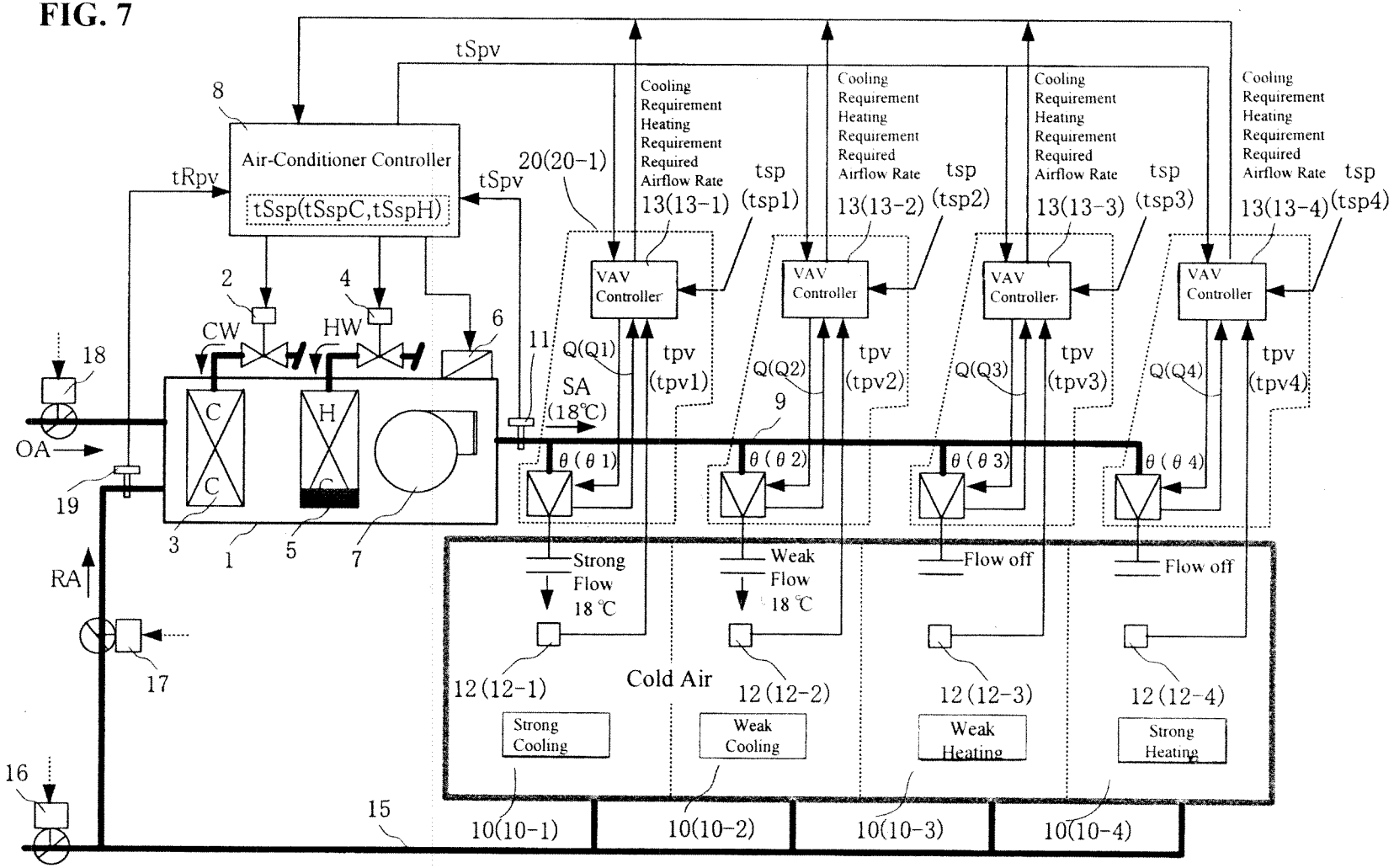
FIG. 7 is a diagram illustrating an example of the state of control of the VAV controlling system when the supply air temperature setting value is switched to the cold air temperature setting value.
Figure 8:
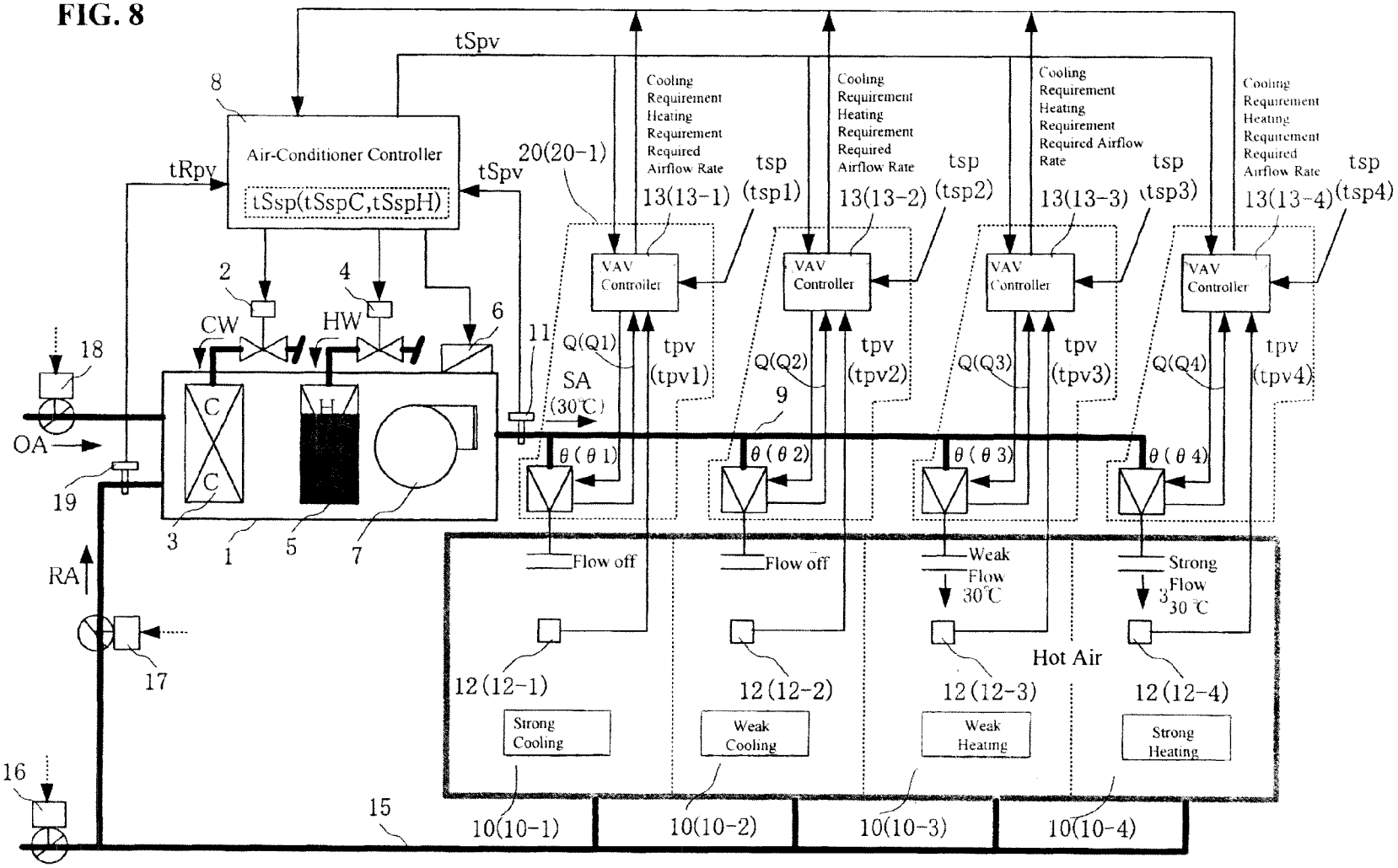
FIG. 8 is a diagram illustrating an example of the state of control of the VAV controlling system when the supply air temperature setting value is switched to the hot air temperature setting value.

FIG. 6 (*b*) illustrates the changes in the supply air temperature tSpv during cold air/hot air switching control when the cold air temperature setting value tSspC is 18° C. and the hot air temperature setting value tSspH is 30° C. In this case, when the cold air temperature setting value tSspC is 18° C., then, as illustrated in FIG. 7, for example, the amount of hot water HW to the hot water coil 5 is reduced in order to supply cold air. When the hot air temperature setting value tSspH is 30° C., then, for example, as illustrated in FIG. 8, the amount of hot water HW to the hot water coil 5 is increased in order to supply hot air.

Here let us assume that, for example, the cooling requirements were made by the VAV controllers 13-1 and 13 2, and the heating requirements were made by the VAV controllers 13-3 and 13-4.

In this case, if the VAV controllers 13-1 and 13-2, which made the cooling requirements, determine, through their own supply air blocking functions (the second supply air blocking functions) that hot air is being supplied as the supply air (tpv<tSpv), then they block the supply of air to the controlled areas 10-1 through 10-2. (See FIG. 6 (*c*) and FIG. 8.) Doing so regulates the airflow rates Q to the controlled areas 10-1 and 10-2 so as to supply air only when cold air is being supplied as the supply air. (See FIG. 6 (*c*) and FIG. 7.)

Moreover, if the VAV controllers 13-3 and 13-4, which made the heating requirements, determine, through their own supply air blocking functions (the first supply air blocking functions) that cold air is being supplied as the supply air (tSpv<tpv), then they block the supply of air to the controlled areas 10-3 and 10-4. (See FIG. 6 (*d*) and FIG. 7.) Doing so regulates the airflow rates Q to the controlled areas 10-3 and 10-4 so as to supply air only when hot air is being supplied as the supply air. (See FIG. 6 (*d*) and FIG. 8.)

In this case, there will be intermittent operation wherein cold air is blown repetitively into the controlled areas 10-1 and 10-2, and intermittent operation wherein hot air is blown repetitively into the controlled areas 10-3 and 10-4, and because in this intermittent operation the air cooling and heating control is as ordinary control, the residents have little feeling that there is anything out of the ordinary, so this will not be a particularly large problem. Moreover, even for the air cooler and heater 1, this is switching between low-heating and high-heating, which does not produce any particular mixing loss.

Doing this makes it possible to respond to the cooling requirements from the VAV controllers 13-1 and 13-2 and to the heating requirements from the VAV controllers 13-3 and 13-4, that is, this makes it possible to respond to simultaneous requirements for cooling and heating from the VAV controllers 13-1 through 13-4, through clever distribution of cooling and heating in the time domain. In this way, a time switching-type cooling/heating-free VAV controlling system is achieved in the present example.

Note that while in the present example the heating temperature setting value tSspH was calculated from the heating requirement count (in FIG. 4 (*a*)) and the cold air/hot air switching time interval T was calculated from the cooling requirement count (in FIG. 4 (*b*)) in the air-cooler-and-heater controller 8, the heating temperature setting value tSspH may be calculated instead from the cooling requirement count, and the cold air/hot air switching time interval T may be calculated instead from the heating requirement count. Moreover, the cold air/hot air switching time interval T and the heating temperature setting value tSspH may be calculated from a count of either of the requirements. The same is true also when the supply air is hot air.

Moreover, while in the present example the cold air/hot air switching control was performed over a cold air/hot air switching control execution time interval TC that was set in advance, instead the cold air/hot air switching control may be terminated when a VAV system environment that is a trigger for the cold air/hot air switching control goes to one wherein the room temperature setting value is approximately the room temperature, or the cold air/hot air switching control may be terminated when an environment other than the VAV system that is the trigger for the cold air/hot air switching control has deviated greatly from a setting.

Figure 9:
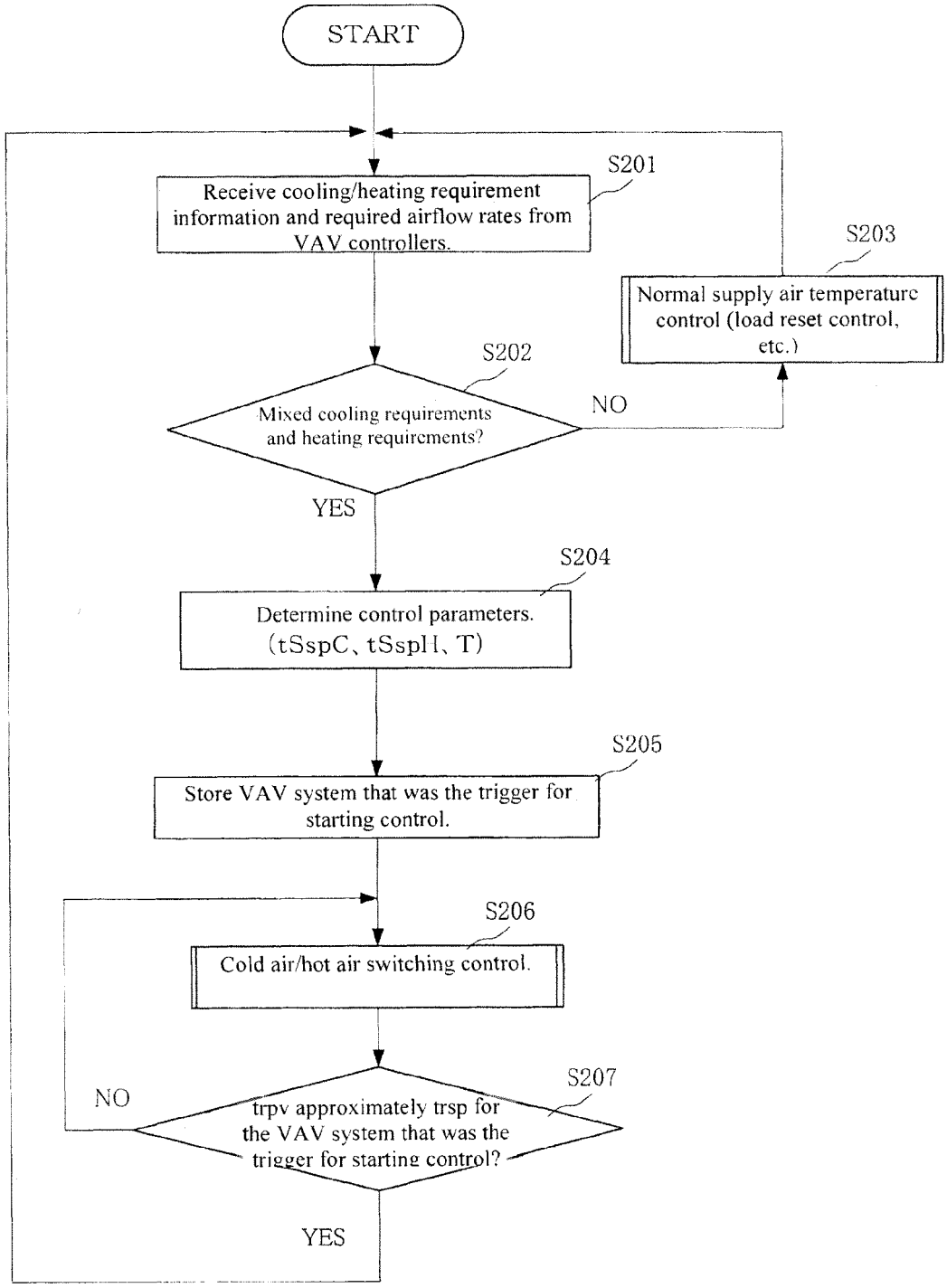
FIG. 9 is a flowchart for a case wherein the cold air/hot air switching control is terminated when the environment of the VAV system that has been the trigger for the cold air/hot air switching control becomes such that the room temperature setting value is approximately the room temperature for another example.

A flowchart is shown as another example in FIG. 9 for a case wherein the cold air/hot air switching control is terminated when an environment for the VAV system that was the trigger for the cold air/hot air switching control has gone to one wherein the room temperature setting value is approximately the room temperature.

In this case, if the air-cooler-and-heater controller 8 receives cooling/heating requirement information from the VAV controllers 13-1 through 13-4 (Step S201) and detects that there is a mixture of a cooling requirement and a heating requirement (Step S202: YES), it establishes the cold air temperature setting value tSspC, the hot air temperature setting value tSspH, and the cold air/hot air switching time interval T as the control parameters (Step S204), and stores the VAV system that was the trigger for the commencement of control (Step S205).

For example, in FIG. 1, if the VAV controllers 13-1 through 13-4 had been sending, up until that point, cooling requirements, and the VAV controller 13-4 begins to send a heating requirement, then the system for the VAV controller 13-4 is stored as the VAV system that was the trigger for the commencement of control.

Figure 3:
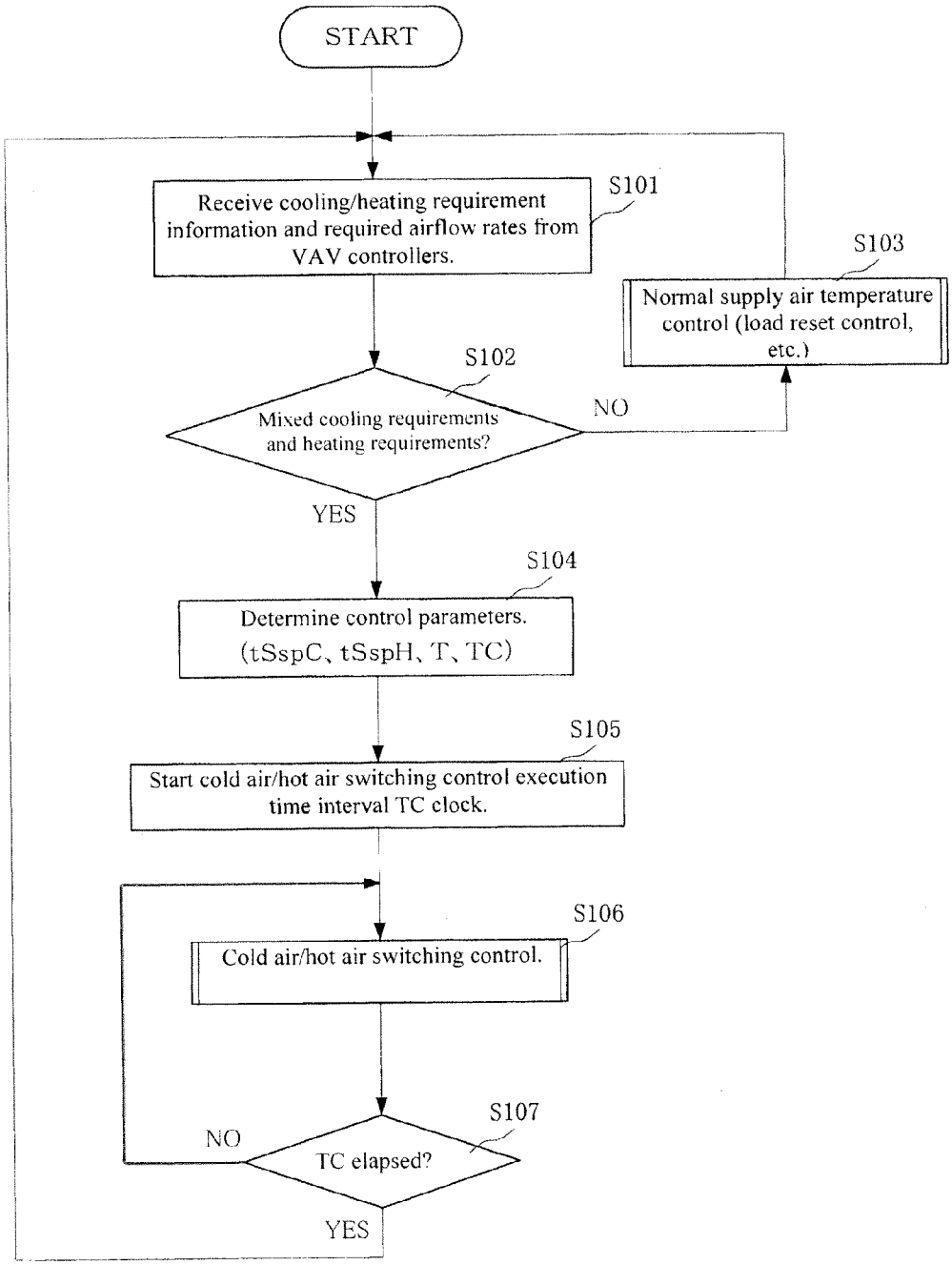
FIG. 3 is a flowchart for explaining the cold air/hot air switching function of the air-cooler-and-heater controller in the VAV controlling system.

Given this, in the same manner as in Step S106, illustrated in FIG. 3, the cold air/hot air switching control is started using the cold air temperature setting value tSspC, the hot air temperature setting value tSspH, and the cold air/hot air switching time interval T that were established in Step S204 (Step S206). After this, the cold air/hot air switching control is terminated at the point in time that the environment of the VAV system that was the trigger for the commencement of control goes to one wherein the room temperature setting value is approximately the room temperature (Step S207: YES).

For example, if the VAV system that was the trigger for the commencement of control was the system for the VAV controller 13-4, then the cold air/hot air switching control would be terminated at the point in time wherein the room temperature tpv4 within the controlled area 10-4 goes to essentially the room temperature setting value tsp4.

Figure 10:
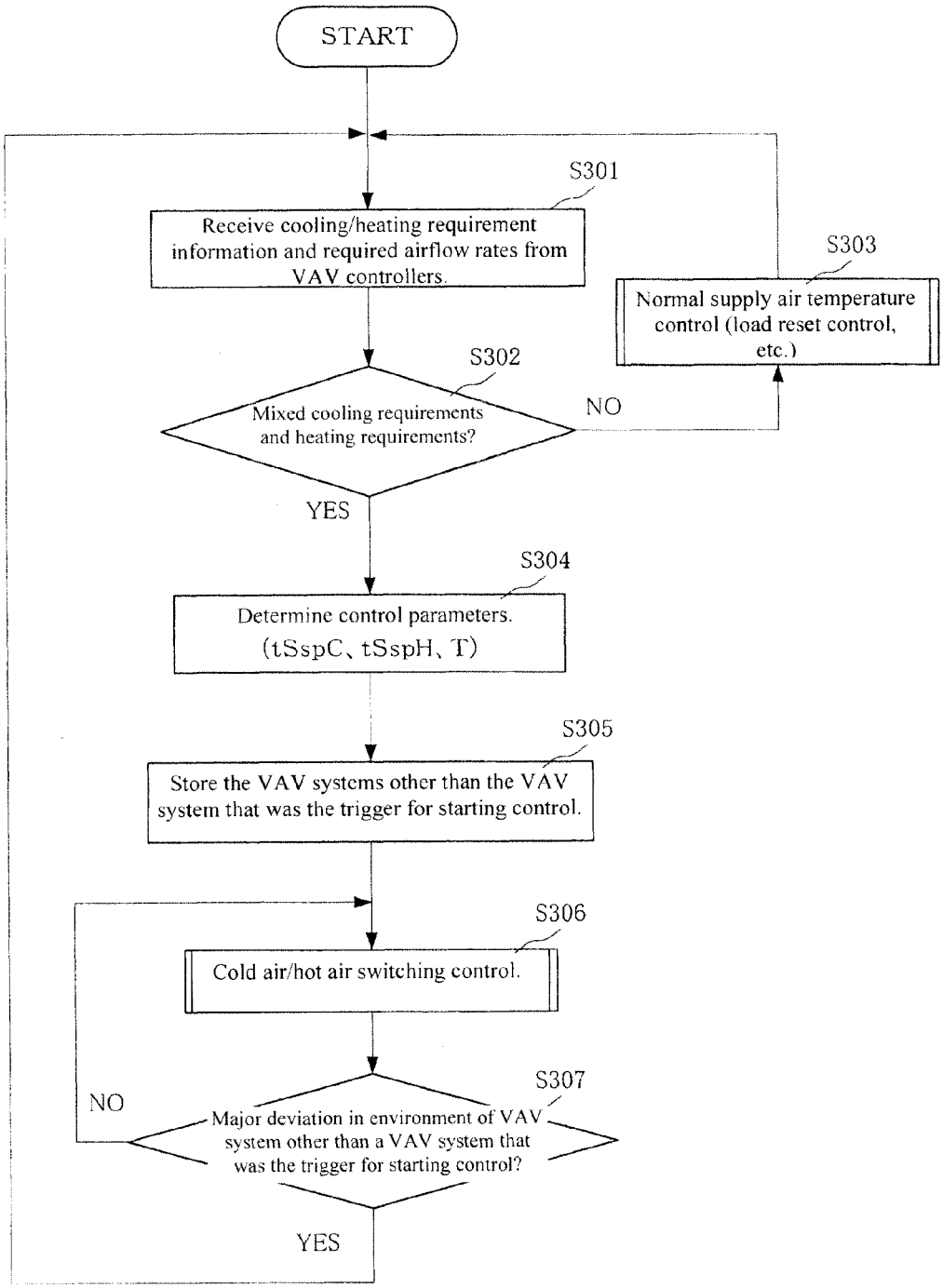
FIG. 10 is a flowchart for a case wherein the cold air/hot air switching control has been terminated in a case wherein an environment other than the VAV system that has triggered the cold air/hot air switching control has deviated greatly from a setting.

A flowchart is illustrated in FIG. 10 as a further example for a case wherein the cold air/hot air switching control is terminated when an environment other than that of the VAV system that was the trigger for the cold air/hot air switching control deviates greatly from a setting.

In this case, if the air-cooler-and-heater controller 8 receives cooling/heating requirement information from the VAV controllers 13-1 through 13-4 (Step S301) and detects that there is a mixture of a cooling requirement and a heating requirement (Step S302: YES), it establishes the cold air temperature setting value tSspC, the hot air temperature setting value tSspH, and the cold air/hot air switching time interval T as the control parameters (Step S304), and stores the VAV systems other the VAV system that was the trigger for the commencement of control (Step S305).

For example, in FIG. 1, if the VAV controllers 13-1 through 13-4 had been sending, up until that point, cooling requirements, and the VAV controller 13-4 begins to send a heating requirement, then the system for the VAV controllers 13-1 through 13-2 are stored as the VAV systems other than the VAV system that was the trigger for the commencement of control.

Given this, in the same manner as in Step S106, illustrated in FIG. 3, the cold air/hot air switching control is started using the cold air temperature setting value tSspC, the hot air temperature setting value tSspH, and the cold air/hot air switching time interval T that were established in Step S304 (Step S306). Given this, the cold air/hot air switching control is terminated at the point in time wherein an environment of a VAV system that is other than the VAV system that was the trigger for the commencement of control has deviated greatly from a setting (Step S307: YES).

For example, if the VAV systems that are other than the VAV system that triggered the commencement of control are the systems for the VAV controllers 13-1 through 13-3, then the cold air/hot air switching control would be terminated at the point in time wherein one or more of the room temperatures tpv1 through tpv3 of the controlled areas 10-1 through 10-3 were to greatly deviate from the room temperature setting values tsp1 through tsp3.

In another example, a function is provided in the air-cooler-and-heater controller 8 wherein, if there is no mixing of a cooling requirement and a heating requirement in the cooling/heating requirement information that has been received, the mixing of a cooling requirement and a heating requirement is predicted from the current load statuses of the controlled areas 10-1 through 10-4, to correct, in the direction of excess-loading, the room temperature setting values of the controlled areas other than the source of a requirement for cooling or heating that is predicted to cause mixing, prior to performing the alternating switching of the cold air temperature setting value tSspC and the hot air temperature setting value tSspH.

Figure 11:
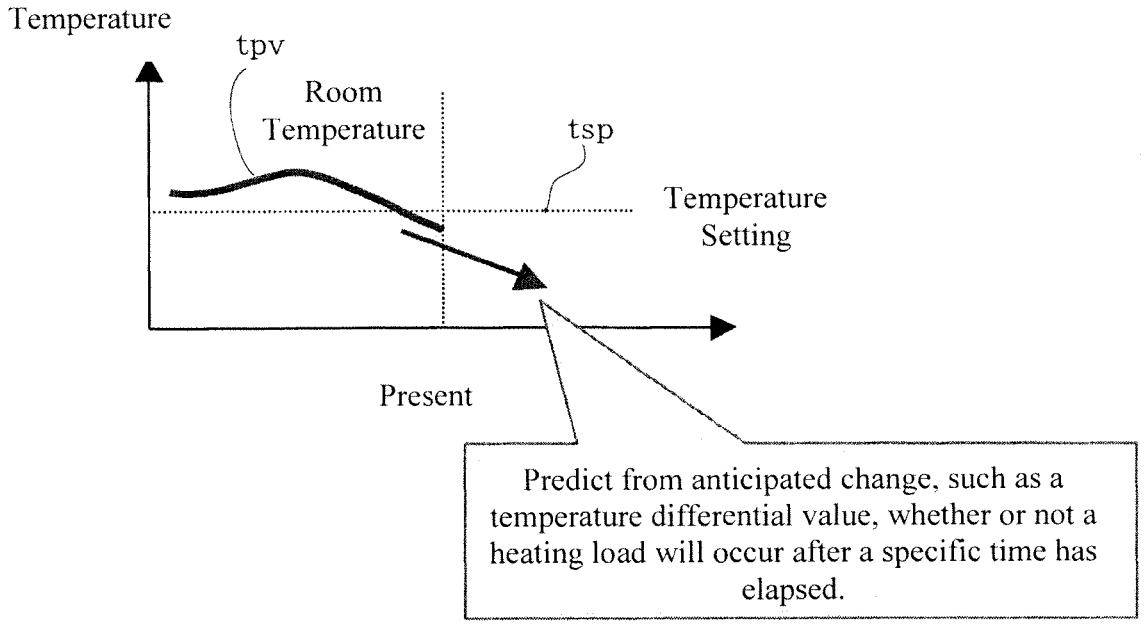
FIG. 11 is a diagram illustrating an example of a state of change of the room temperature in a controlled area (a case wherein the occurrence of a heating load is anticipated).

For example, if there is no mixing of a cooling requirement and a heating requirement in the cooling/heating requirement information that has been received, then, in the air-cooler-and-heater controller 8, occurrence of a heating load or a cooling load after a specific amount of time is predicted from the anticipated changes, such as the room temperature differential values of the room temperatures tpv, in the controlled areas 10-1 through 10-4. (See FIG. 11.)

Here, if, for example, the cooling/heating requirement information from the controlled areas 10-1 through 10-4 are all cooling requirements, and a heating requirement is predicted for the controlled area 10-4, then, prior to performing the alternating switching of the cold air temperature setting value tSspC and the hot air temperature setting value tSspH, the room temperature setting values tsp1 through tsp3 of the controlled areas 10-1 through 10-3, excluding the controlled area 10-4 as the predicted source that would cause the cooling/heating requirements to be mixed (that is, the source of a cooling/heating requirement wherein the state of the cooling/heating requirement information is anticipated to go into the opposite state than that of the current cooling/heating requirement information) are corrected to room temperature setting values that are lower (by between about 1 and 3° C.) than the current room temperature setting values.

Doing so causes excess-cooling control to be performed prior to the cold air/hot air switching control in the controlled areas 10-1 through 10-3, preventing so much of a negative effect on the environment at the actual time of the cold air/hot air switching control.

Note that in this example, the excess-cooling control of the controlled areas 10-1 through 10-3 may be continued during the cold air/hot air switching control, or control may return to normal control during the cold air/hot air switching control.

Moreover, while in the example, the occurrence of the heating load or the cooling load was predicted from the anticipated change of the temperature differential value of the room temperature tpv, instead the occurrence of the heating load or cooling load may be predicted from the relationships between the magnitudes of the cooling/heating requirements that have been received.

Figure 12:
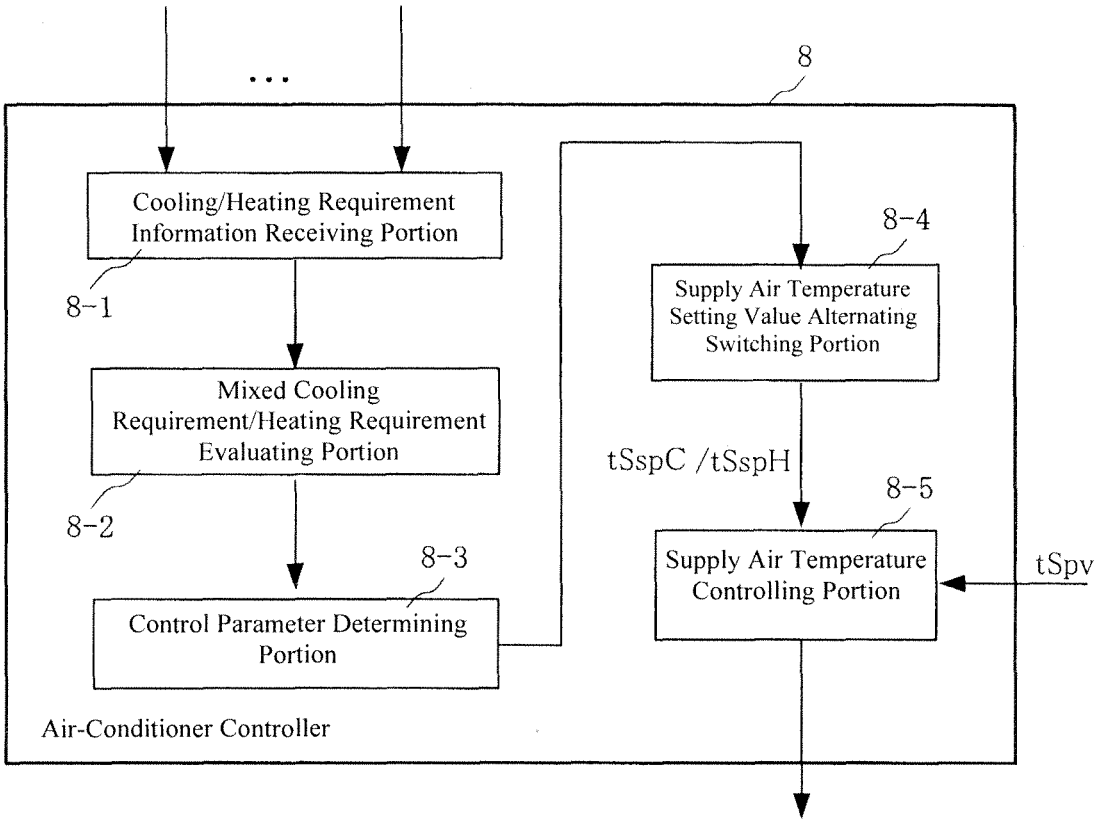
FIG. 12 is a functional block diagram of the critical components of an air cooling and heating controller.

FIG. 12 shows a functional block of the key portions of the air-cooler-and-heater controller 8 described above. The air-cooler-and-heater controller 8 includes a cooling/heating requirement information receiving portion 8-1 for receiving cooling/heating requirement information from the VAV controllers 13-1 through 13-4; a mixed cooling requirement/heating requirement evaluating portion 8-2 for evaluating whether or not there is mixing of a cooling requirement and a heating requirement in the cooling/heating requirement information that has been received by the cooling/heating requirement information receiving portion 8-1; a control parameter determining portion 8-3 for determining the cold air temperature setting value tSspC, the hot air temperature setting value tSspH, and the like, when a mixing of a cooling requirement and a heating requirement has been identified by the mixed cooling requirement/heating requirement evaluating portion 8-2; a supply air temperature setting value alternating switching portion 8-4 for performing the alternating switching of the cold air temperature setting value tSspC and the hot air temperature setting value tSspH based on the control parameters that have been determined by the control parameter determining portion 8-3; and a supply air temperature controlling portion 8-5 for setting the supply air temperature setting value tSsp to the cold air temperature setting value tSspC or the hot air temperature setting value tSspH that are switched alternatingly by the supply air temperature setting value alternating switching portion 8-4, to control the supply air temperature so as to cause the supply air temperature tSpv to go to the supply air temperature setting value tSsp.

Figure 13:
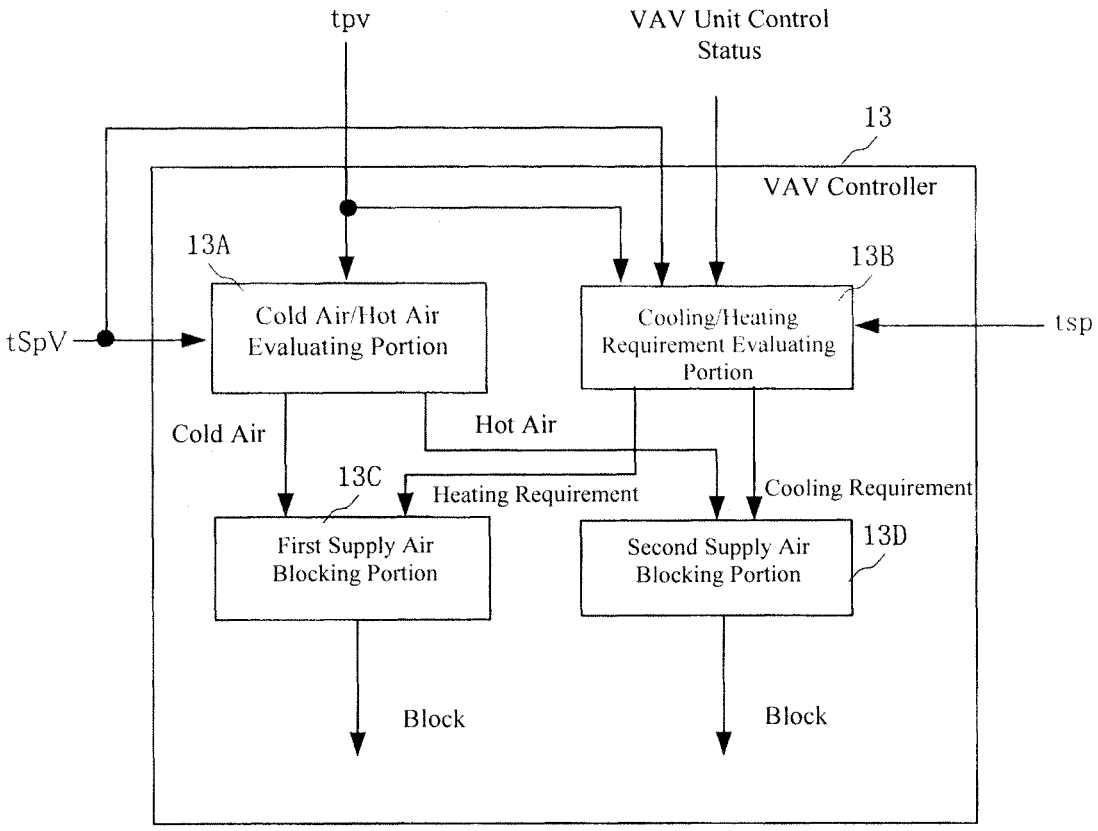
FIG. 13 is a functional block diagram of the critical components of a VAV controller.

FIG. 13 shows a functional block diagram of the critical portions of the VAV controller 13, described above. A VAV controller 13 includes a cold air/hot air evaluating portion 13A for comparing the supply air temperature tSpv and the room air temperature tpv to determine that cold air is being supplied as the supply air when the supply air temperature tSpv is less than the room air temperature tpv (tSpv<tpv) and determining that hot air is being supplied as the supply air when the supply air temperature tSpv is greater than the room temperature tpv (tpv<tsp); a cooling/heating requirement evaluating portion 13B for evaluating whether the current load status of the controlled area 10 that the VAV controller 13 is controlling requires cooling or requires heating; a first supply air blocking portion 13C for blocking the supply of air to the area 10 when the cooling/heating requirement evaluating portion 13B has determined that heating is required and the cold air/hot air evaluating portion has identified cold air; and a second supply air blocking portion 13D for blocking the supply of air to the controlled area 10 when the cooling/heating requirement evaluating portion 13B has determined that cooling is required and the cold air/hot air evaluating portion 13A has identified hot air.

Note that while the examples set forth above used a system structure wherein the controllers were divided into an air-cooler-and-heater controller 8 and VAV controllers 13 (13-1 through 13-4); instead the functions of the air-cooler-and-heater controller 8 and the functions of the VAV controllers 13 (13-1 through 13-4) may be housed in the same controller (control device), and the control of the supply airflow rates to the controlled areas 10 (10-1 through 10-4) and the control of the temperature of the supply air from the air cooler and heater 1 may be performed by this single control device.

The air cooling and heating controlling system and air cooling and heating controlling method according to the examples of the present invention, as an air cooling and heating controlling system and air cooling and heating controlling method for controlling the airflow rates of supply air that is supplied to a plurality of controlled areas by an air cooler and heater in accordance with the load statuses of the controlled areas, and for controlling the temperature of the air that is supplied from the air cooler and heater so as to go to a supply air temperature setting value, can be used in multi-loop air cooling and heating controlling systems such as VAV controlling systems.

The invention claimed is:

1. An air-cooling-and-heating controlling system comprising:

a plurality of supply air flow rate controllers controlling flow rates of supply air that is supplied from an air cooler and heater to a plurality of controlled areas in accordance with load statuses of the controlled areas, and a supply air temperature controller controlling, to a supply air temperature setting value, the supply air temperature that is supplied from the air cooler and heater to the plurality of controlled areas, wherein:

each supply airflow rate controller comprises:

a requirement sending device sending to the supply air temperature controller cooling/heating requirement information indicating whether current load status of the controlled area controlled by that supply air flow rate controller requires cooling or requires heating;

the supply air temperature controller comprises:

a cold air/hot air switching device receiving the cooling/heating requirement information sent from an individual supply air flow rate controller, setting a cold air temperature setting value and a hot air temperature setting value able to accommodate the cooling/heating requirements at that time when there is a mixture of a cooling requirement and a heating requirement in the cooling/heating requirement information that has been received, and for alternatingly switching the supply air temperature setting value between the cold air temperature setting value and the hot air temperature setting value that have been determined, wherein the cold air/hot air switching device determines the cold air temperature setting value, the hot air temperature setting value, and a time interval for alternatingly switching between the cold air temperature setting value and the hot air temperature setting value, based on a relationship of magnitudes of the cooling requirements and the heating requirements when there is a mixture of the cooling requirement and the heating requirement in the cooling/heating requirement information that has been received, and wherein the cold air/hot air switching device, when there is no mixing of a cooling requirement and a heating requirement in the cooling/heating requirement information that has been received, predicts, from the current load statuses of an individual controlled areas, a mixing of a cooling requirement and a heating requirement, and, prior to performing alternating switching of the cold air temperature setting value and the hot air temperature setting value, corrects, in a direction of excess-loading, room temperature setting values for controlled areas other than a source of a cooling/heating requirement for which the cooling/heating requirement information is predicted to go to a state that is opposite of current cooling/heating requirement.

2. The air-cooling-and-heating controlling system as set forth in claim 1, wherein:

each supply air flow rate controller is provided in a VAV controller that is provided for each individual controlled area; and the supply air temperature controller is provided in an air cooler and heater controller that is provided for the air cooler and heater.

3. The air-cooling-and-heating controlling system as set forth in claim 1, wherein:

the individual supply airflow rate controller and the supply air temperature controller are provided in a single control device.

4. The air-cooling-and-heating controlling system as set forth in claim 1, wherein:

each individual supply air flow rate controller comprises:

a first supply air blocking device blocking the supply of air to the controlled area when the current load status of the controlled area it controls requires heating and cold air is supplied as the supply air from the air cooler and heater; and a second supply air blocking device blocking the supply of air to the controlled area when the current load status of the controlled area it controls requires cooling and hot air is supplied as the supply air from the air cooler and heater.

5. An air-cooling-and-heating controlling method applied to a system comprising a plurality of supply air flow rate controller controlling flow rates of supply air that is supplied from an air cooler and heater to a plurality of controlled areas in accordance with load statuses of the controlled areas, and supply air temperature controller controlling, to a supply air temperature setting value, the supply air temperature that is supplied from the air cooler and heater, comprising a steps of:

a requirement sending step sending, from each supply airflow rate controller, cooling/heating requirement information indicating whether current load status of the controlled area controlled by that supply air flow rate controller requires cooling or requires heating;

a cold air/hot air switching step receiving the cooling/heating requirement information sent from an individual supply air flow rate controller, setting a cold air temperature setting value and a hot air temperature setting value able to accommodate the cooling/heating requirements at that time when there is a mixture of a cooling requirement and a heating requirement in the cooling/heating requirement information that has been received, and for alternatingly switching the supply air temperature setting value between the cold air temperature setting value and the hot air temperature setting value that have been determined;

the cold air/hot air supplying step determines the cold air temperature setting value, the hot air temperature setting value, and a time interval for alternatingly switching between the cold air temperature setting value and the hot air temperature setting value, based on a relationship of the magnitudes of the cooling requirements and the heating requirements when there is a mixture of a cooling requirement and a heating requirement in the cooling/heating requirement information that has been received, and the cold air/hot air switching step, when there is no mixing of a cooling requirement and a heating requirement in the cooling/heating requirement information that has been received, predicts, from the current load statuses of the individual controlled areas, a mixing of a cooling requirement and a heating requirement, and, prior to performing alternating switching of the cold air temperature setting value and the hot air temperature setting value, corrects, in the direction of excess-loading, the room temperature setting values for controlled areas other than a source of a cooling/heating requirement for which the cooling/heating requirement information is predicted to go to a state that is opposite of a current cooling/heating requirement.

6. The air-cooling-and-heating controlling method as set forth in claim 5, wherein:

each individual supply air flow rate controller is provided in a VAV controller that is provided for each individual controlled area; and each supply temperature controller is provided in an air cooler and heater controller that is provided for the air cooler and heater.

7. The air-cooling-and-heating controlling method as set forth in claim 5, wherein:

the individual supply air flow rate controller and the supply air temperature controller are provided in a single control device.

8. The air-cooling-and-heating controlling method as set forth in claim 5, wherein:

a first supply air blocking step blocking, in each supply airflow rate controller, the supply of air to the controlled area when the current load status of the controlled area it controls requires heating and cold air is supplied as the supply air from the air cooler and heater; and a second supply air blocking step blocking, in each supply airflow rate controller, the supply of air to the controlled area when the current load status of the controlled area it controls requires cooling and hot air is supplied as the supply air from the air cooler and heater.

* * * * *